US005762618A

United States Patent [19]

Yamanaka et al.

[11] Patent Number: 5,762,618

[45] Date of Patent: Jun. 9, 1998

[54] CHAIR-TYPE AIR MASSAGE DEVICE

[75] Inventors: Nobuyuki Yamanaka; Masaki Wada, both of Osaka, Japan

[73] Assignee: Kabushiki Kaisha Fuji Iryoki, Osaka, Japan

[21] Appl. No.: 662,698

[22] Filed: Jun. 13, 1996

[30] Foreign Application Priority Data

Jun. 14, 1995 [JP] Japan ..... 7-171547

[51] Int. Cl.[6] ..... A61H 7/00

[52] U.S. Cl. ..... 601/148; 601/149; 601/151; 601/152

[58] Field of Search ..... 601/148, 149, 601/150, 151, 152, 49

[56] References Cited

U.S. PATENT DOCUMENTS

| | | | |
|---|---|---|---|
| 2,684,672 | 7/1954 | Summerville | 601/148 |
| 3,092,100 | 6/1963 | Oetinger | 601/57 |
| 3,483,862 | 12/1969 | Takeuchi | 601/149 |
| 3,536,063 | 10/1970 | Werding | 601/152 |
| 3,595,223 | 7/1971 | Castagna . | |
| 3,613,671 | 10/1971 | Poor | 601/149 |
| 3,654,919 | 4/1972 | Birtwell | 601/152 |
| 3,760,801 | 9/1973 | Borgeas | 601/149 |
| 3,783,859 | 1/1974 | Sauer et al. | 601/152 |
| 3,924,613 | 12/1975 | Beck | 601/149 |
| 4,258,706 | 3/1981 | Shank . | |
| 4,981,131 | 1/1991 | Hazard | 601/150 |
| 5,022,385 | 6/1991 | Harza . | |
| 5,135,282 | 8/1992 | Pappers | 601/148 |
| 5,314,403 | 5/1994 | Shaw . | |
| 5,437,608 | 8/1995 | Cutler . | |
| 5,462,516 | 10/1995 | Anderson | 601/99 |

FOREIGN PATENT DOCUMENTS

| | | | |
|---|---|---|---|
| 270-699 A | 6/1988 | European Pat. Off. | 601/148 |
| 2-45902 | 10/1990 | Japan . | |
| 4-327849 | 11/1992 | Japan | 601/148 |
| 405 285 182 | 11/1993 | Japan . | |
| 1 477 407 | 5/1989 | U.S.S.R. . | |

*Primary Examiner*—Robert A. Hafer
*Assistant Examiner*—Benjamin Koo
*Attorney, Agent, or Firm*—Flynn, Thiel, Boutell & Tanis, P.C.

[57] ABSTRACT

A chair-type air massage device which is capable of providing air massage to a user's legs in comfortable positions such as a reclined position or a sitting position. The air massage device includes a backrest pivotally joined with a seat. A footrest is joined to the front end of the seat and can be moved between a forwardly-projecting or extended position and a retracted position. A number of air bags for providing a leg massage are disposed on the footrest. When the footrest is in the extended position, a user's legs may be oriented approximately horizontally and compressed air may be supplied and exhausted to and from the air bags so as to cause the air bags to expand and contract and thus massage the user's legs in a reclined position. Likewise, when the footrest is in the retracted position, a user's legs may be oriented approximately vertically and compressed air may be supplied and exhausted to and from the air bags so as to cause the air bags to expand and contract and thus massage the user's legs in a sitting position.

2 Claims, 5 Drawing Sheets

CHAIR-TYPE AIR MASSAGE DEVICE

CROSS-REFERENCE TO RELATED APPLICATIONS

Cross reference is made to our co-pending U.S. patent application Ser. No. 08/662,703, entitled "CHAIR-TYPE AIR MASSAGE DEVICE" (Atty Ref: Techno Case 48) which is assigned to the same assignee as the present invention, and filed concurrently herewith.

BACKGROUND OF THE INVENTION

1. Field of the Invention

This invention relates to a chair-type massage device, especially a chair-type air massage device which has inflatable and deflatable air bags which are positioned in a footrest for massaging a user's legs by varying the air pressure within the air bags to cause expansion and contraction of the air bags.

2. Description of the Prior Art

Previously, various kinds of chair-type massaging devices, for example, a chair-type kneading massage device equipped with a kneading function, a chair-type knocking massage device equipped with a knocking function, a chair-type rolling massage device equipped with a rolling function, and a chair-type finger pressure massage device equipped with a finger pressure function have been developed and manufactured and each of them has its own characteristic function so that users can select one according to their preference to use.

However, females and older people tend to avoid using them because the conventional chair-type massage devices provide strong friction against a user's skin. Therefore, in recent years, the development of a chair-type massage device which gives not only rather weak friction but also a massage effect has been desired.

In compliance with this requirement, a chair-type air massage device which has air bags in a body of a chair in order to massage a user's local body part by using air pressure to expand and contract air bags has been recently developed.

This chair-type air massage device, such as disclosed in Japanese Patent Publication No. 45902 (1990), is equipped with several air bags installed in the backrest. The neck, back and waist of a human body can be massaged by sequentially supplying and exhausting compressed air to several air bags to expand and contract them.

In the above-mentioned chair-type air massage device, it is convenient that the friction against a user's skin is weaker than conventional chair-type massage devices and the appropriate massaging effect can be provided because it is designed to massage a user's neck, back or waist by expanding and contracting the air bags. However, there is a problem in that friction against a user's legs is rather weak, and an air pressure massage cannot be provided to a user's legs since the known chair-type air massage device provides a massage mainly to a user's back.

SUMMARY OF THE INVENTION

An object of the present invention is to provide a chair-type air massage device which is capable of providing an air massage to a user's legs in comfortable positions such as sitting and lying on his back.

A chair-type air massage device of the present invention is equipped with a reclinable backrest which is installed on the rear end of a seat and a footrest which can be varied between a forwardly-projected position and a retracted position below the front end of the seat, air bags for massaging a user's legs while positioned on the footrest, and an intake/exhaust control mechanism which supplies and exhausts compressed air to the air bags.

Further, in a chair-type air massage device of the present invention, the air bags for a leg massage include right and left air bags and center air bags provided between the right and left air bags.

Still further, in the present invention, the center air bags are formed as separate left and right center air bags.

Still further, in the present invention, shin covers are removably disposed forward of the left air bag and the center left air bag, and forward of the right air bag and the center right air bag, for retaining a user's legs on the footrest during a leg massage.

A reclinable backrest is joined to the rear end of a seat, a footrest is disposed on the front end of the seat so as to project forward in a forwardly-projected position, air bags for a leg massage are expanded and contracted by an intake/exhaust control means in the footrest. Thus, the backrest can be inclined rearward at any desirable angle and the footrest can be projected forward at the same time. Therefore, an air massage can be provided in a comfortable position when a user simply stretches his legs and places them on the footrest in the projected position. The air massage is provided by expanding and contracting the air bags by supplying and exhausting compressed air to the air bags.

Further, using the present invention in the retracted position wherein a footrest is retracted toward the seat, an air massage can be provided to a user's legs while the user is in an upright sitting position with the user's legs extending downward in contact with the footrest.

Still further, the present invention includes removable shin covers disposed forwardly of each of the air bags in the footrest. Thus, a user's legs can be retained without being pushed away from the air bags thereby efficiently providing an air massage to the user's legs when the air bags are expanded and contracted.

Other objects and purposes of the invention will be apparent to persons familiar with devices of this general type upon reading the following specification and inspecting the accompanying drawings.

PREFERRED EMBODIMENT OF THE INVENTION

Figure 1:
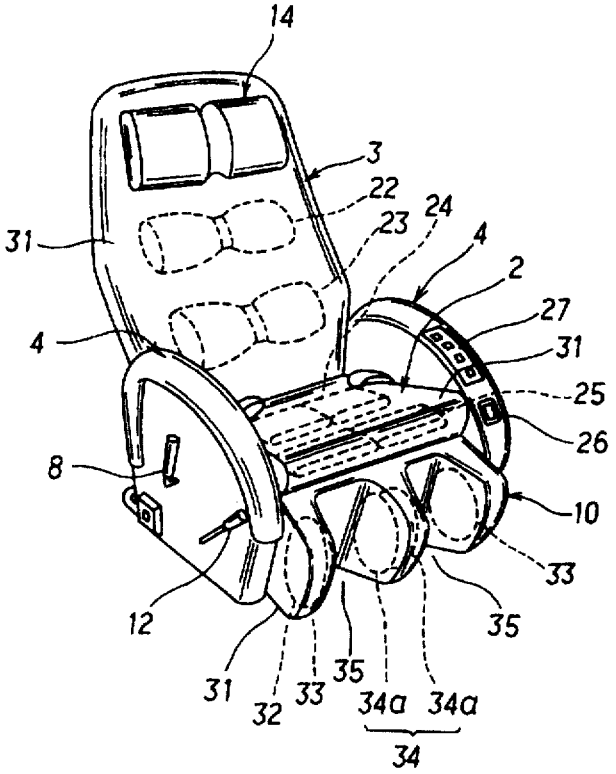
FIG. 1 is a perspective view showing an embodiment of the chair-type air massage device of the present invention.
Figure 2:
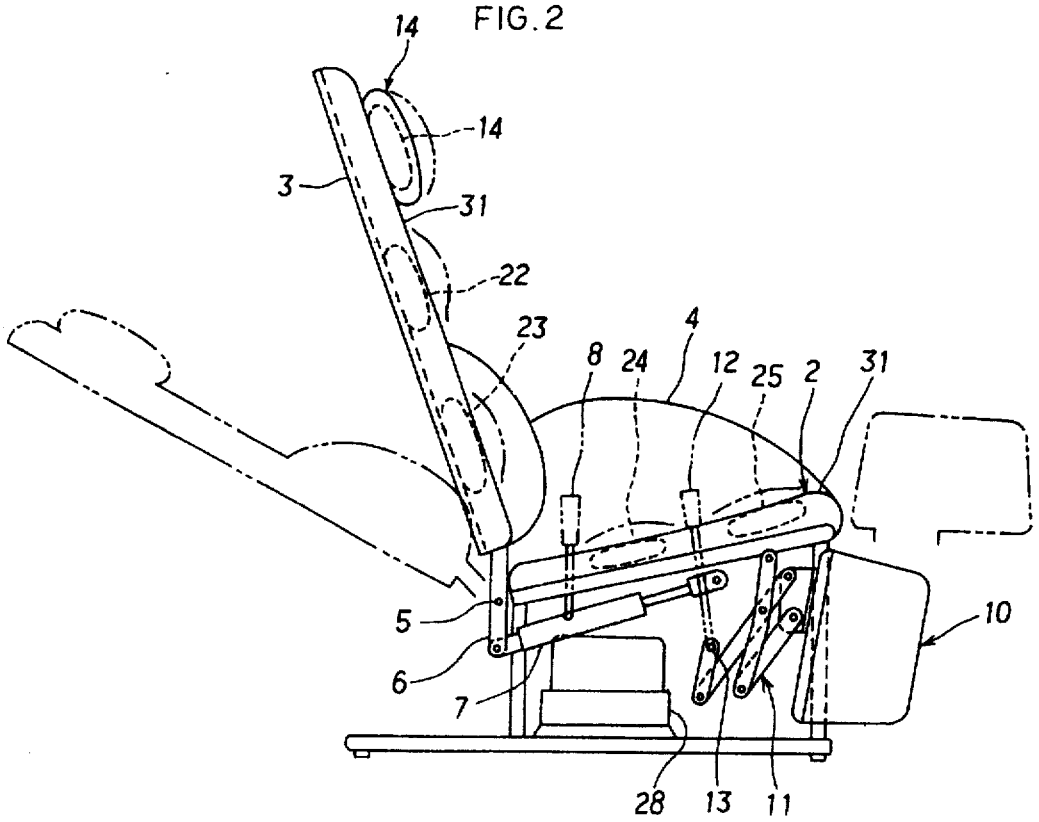
FIG. 2 is a sectional view of the chair-type air massage device of the present invention.

FIG. 1 shows a perspective view and FIG. 2 shows a center longitudinal sectional view of an embodiment of the air massage chair of the present invention. The air massage chair comprises a seat 2, backrest 3 secured to the seat 2 and having an adjustable inclination relative to the seat 2, and armrests 4 disposed on right and left sides of the seat 2.

Figure 3:
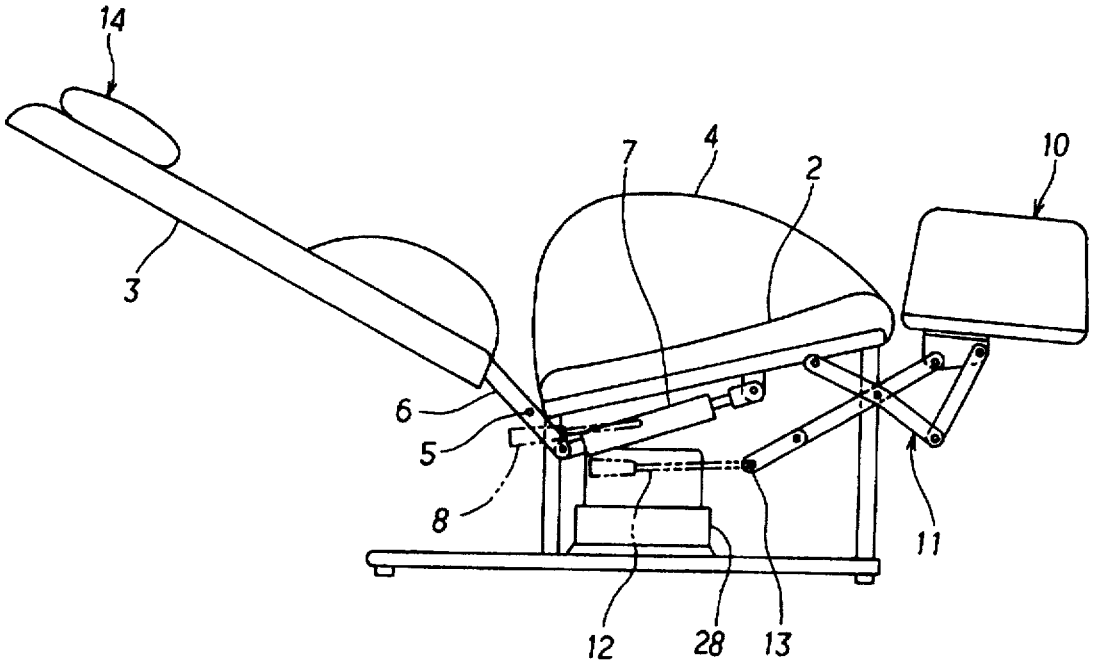
FIG. 3 is a side elevational view of the chair-type air massage device of the present invention.

A mechanism for securing the backrest 3 to the seat 2, for example, as FIG. 2 and FIG. 3 show, includes a frame 6 extending downward below the backrest 3 and secured to the back side of the seat 2 around a rotatable shaft 5 for permitting forward and rearward rocking movement, and a fluid pressure (i.e. hydraulic) cylinder 7 rotatably supported and connected to the lower end of the frame 6 below the rotatable shaft 5. Therefore, the pressure cylinder 7 is operated by a reclining lever 8 disposed on the outer side of the seat 2, such that the backrest 3 can be optionally inclined around the rotatable shaft 5.

A footrest 10 is secured to the front end of the seat 2, and the footrest 10 is capable of changing positions between a projected position wherein it is projected forward of the seat 2 in a nearly horizontal or level orientation wherein it is nearly aligned with the front edge of the seat as shown in FIG. 3, and a retracted position wherein it is retracted below the front end of the seat 2 in a nearly vertical orientation as shown in FIG. 2. For example, the footrest 10 is secured to the seat 2 by linkage 11, and can be changed between the projected position or the retracted position through the linkage 11 by turning a turn shaft 13 around a center thereof by a manual lever 12 which is fixed to the shaft but is disposed on the outer side of the seat 2.

Figure 5:
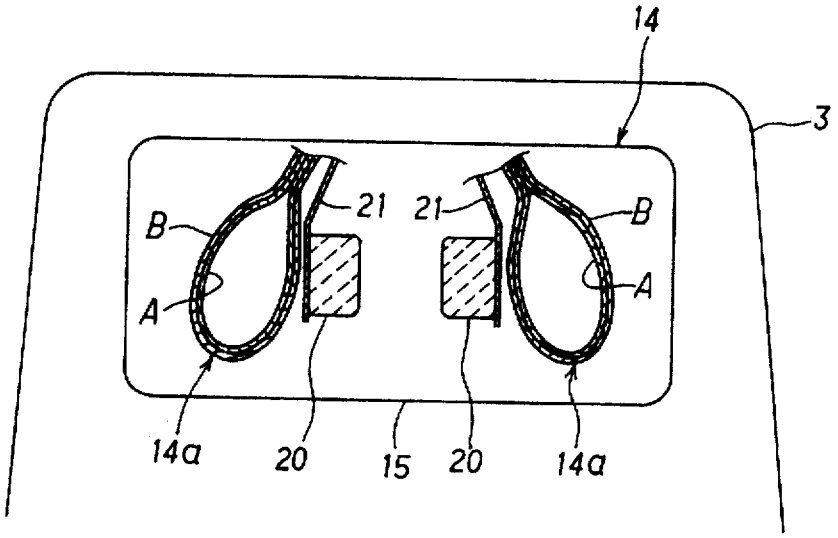
FIG. 5 is a partial cross-section view showing an air bag arrangement for massaging a user's neck in the chair-type air massage device of the present invention.
Figure 6:
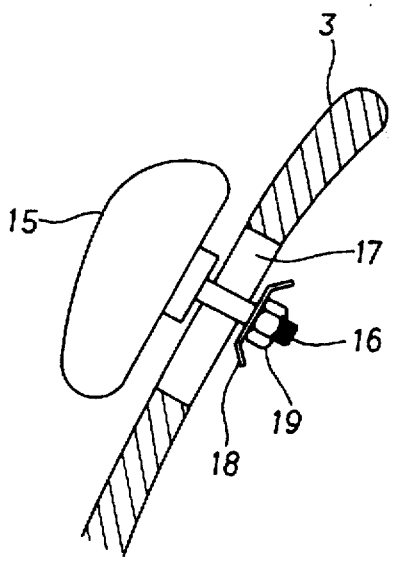
FIG. 6 is a partial cross-section view showing a mechanism for adjusting the position of the air bags for a neck massage relative to a seatback of the chair-type air massage device of the present invention.

Air bags 14 defining a neck massage pillow for permitting a neck massage are secured to the upper part of the backrest 3, and as shown in FIG. 5 and FIG. 6, the right and left air bags 14*a*, 14*a* are placed in a row and covered with a pillowcase or cover 15. A bolt 16 projects from the rear of the pillow defined by air bags 14*a*, 14*a*. The air bags 14 are adjustable in an up and down direction relative to the upper part of the backrest 3 by inserting the bolt 16 from the front side of the backrest 3 through a longitudinal slit 17 provided in the upper part of the backrest 3, and securing a nut 19 to the end of the bolt 16 with a washer 18 positioned under the nut. Therefore, the air bags 14 are positioned by loosening the nut 19 and sliding the air bags 14 to the required position guided by the slit 17 and resecuring the nut 19.

Each air bag 14*a*, 14*a* has a finger pressure ball 20 made of hard urethane foam etc. together with a flexible plate 21 such as a resin plate so that the finger pressure balls 20 can provide a pressurization and de-pressurization function efficiently to both sides of a user's neck according to the expansion of the air bags 14*a*. As shown in FIG. 5 the air bags 14*a*, 14*a* are composed of internal and external layers A, B. Polyurethane, which is effective for air leakage prevention, may be used for the internal layer A, and 6-nylon, which is effective for excessive expansion prevention, may be used for the external layer B.

Figure 4:
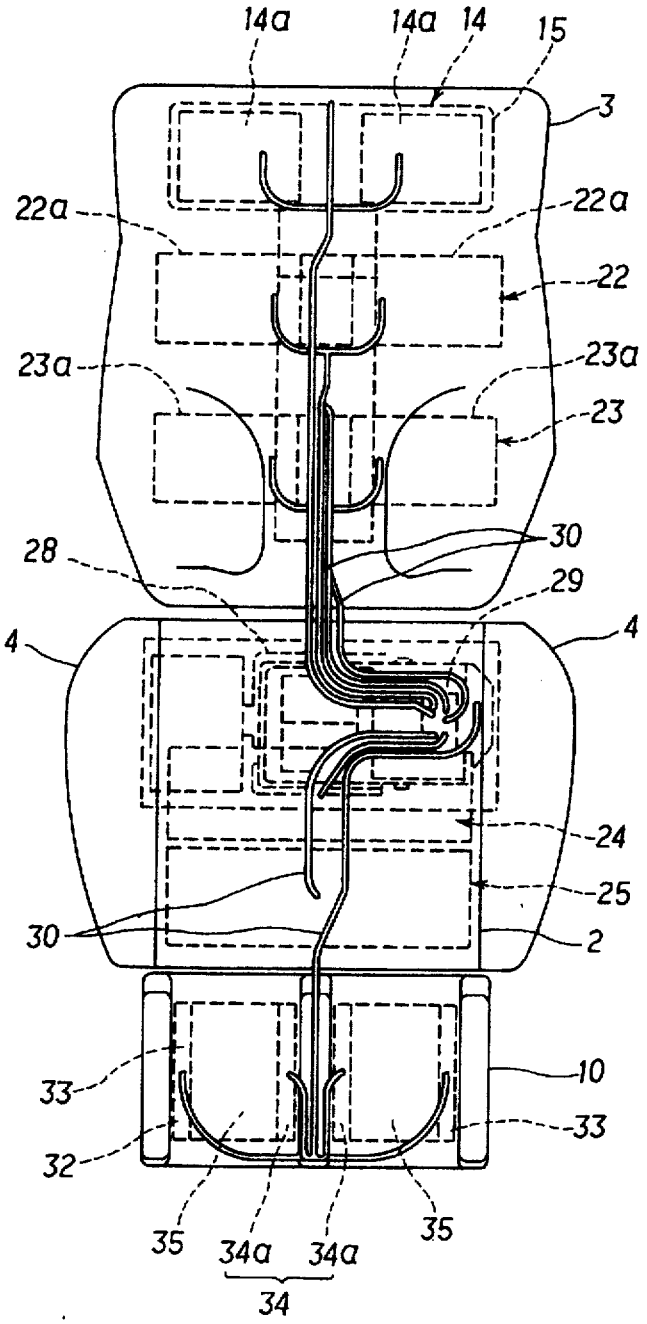
FIG. 4 is a plan view showing an air bag arrangement for massaging a user's various body parts in the air massage device of the present invention.

As shown in FIG. 1 and FIG. 4, air bags 22 for a back massage and air bags 23 for a waist massage are disposed below the air bags 14 on the backrest 3. Each of the air bags 22, 23 is formed by separate left air bags 22*a*, 23*a* and right air bags 22*a*, 23*a* so that they provide and relieve the pressure against the muscle on both sides of a user's spine. Each of the air bags 22, 23 are covered with an exterior cover 31 made of flexible and smooth materials such as chloroethylene leather or cloth etc. which covers the whole backrest 3, and loosely covers each of the air bags 22, 23 so that it expands according to the expansion of each air bag 22, 23.

The air bags 24 for a buttocks massage are installed on the seat 2, and air bags 25 for a thigh massage are installed on the seat 2 in front of the air bags 24. Each of the air bags 24, 25 is also covered with an exterior cover which is made of the same materials as the exterior cover 31 which covers the whole upper surface of the seat 2. The exterior cover 31 covers the air bags 24, 25 loosely so that it can expand according to the expansion of the air bags 24, 25.

Figure 7:
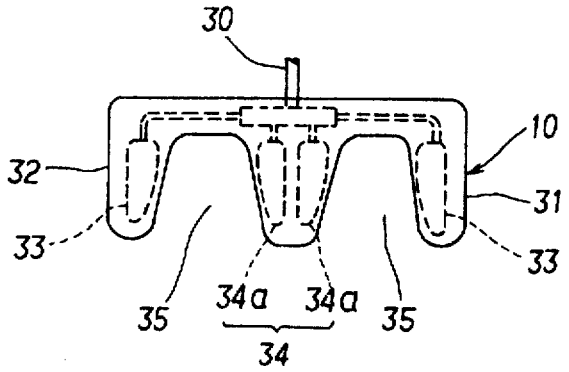
FIG. 7 is a top view showing a first embodiment of a footrest for the chair-type air massage device of the present invention, the footrest having air bags for a leg massage.

The air bags 32 for a leg massage are provided in the footrest 10. As shown in FIG. 7, the air bags 32 for a leg massage include right and left air bags 33, and center air bags 34 provided between the air bags 33. Further, the center air bags 34 are formed as separate left and right center air bags 34*a*, 34*a*. Concave cavities 35, through which each of a user's legs can be placed, are formed between the left air bag 33 and the center left air bag 34*a*, and between the right air bag 33 and the center right air bag 34*a*. The air bags 32 are also covered with the exterior cover 31 made of same materials as the exterior cover 31 which covers the whole footrest 10. This exterior cover covers the air bags 32 loosely so that it can expand according to the expansion of the air bags 32.

Each of the air bags 22, 23, 24, 25, 32 for a back massage, waist massage, buttocks massage, thigh massage and leg massage, respectively, includes internal and external layers formed from the same cross sectional construction as the air bags 14 as shown in FIG. 5.

An intake/exhaust control mechanism which supplies and exhausts compressed air to each of the air bags is disposed in the lower part of the seat 2. As shown in FIG. 1, the intake/exhaust control mechanism has an ON-OFF power switch 26 and several massage selecting switches 27 provided on the armrest 4. As shown in FIG. 4, an air source 28 such as an air compressor or air pump, a distributor 29 having valves (not shown) which distributes compressed air to each air bag from the air source 28, and intake/exhaust ports of each air bag are interconnected by hoses 30.

The massage selecting switches 27 include a general massage button which provides a sequential massage for a user's neck, back, waist, buttocks, thighs, and legs, and several separate massage buttons which selectively provide independent partial massages. Turning on the power switch 26 and pushing the general massage button of the selecting switches 27, for example, sequentially causes each of the air bags 14 for a neck massage, air bags 22 for a back massage, air bags 23 for a waist massage, air bags 24 for a buttocks massage, air bags 25 for a thigh massage, and air bags 32 for a leg massage to repeatedly expand and contract to sequentially provide an air massage to a user's neck, shoulders, back, waist, buttocks, thigh, and legs in order, by varying the air pressure supplied to the air bags. Further, by pushing a button for any of the air bags separately, compressed air can be supplied and exhausted to only specific air bags through the distributor 29 so as to provide an intensive air massage to a user's neck or legs, for example.

When providing a massage to a user's leg(s), a user places his right and/or left legs in the respective cavities 35. Compressed air may be supplied and exhausted to the left air bag 33 and the center left air bag 34*a*, and the right air bag 33 and the center right air bag 34*a*, at the same time or alternately, so as to provide and relieve pressure against the user's calf muscles.

Figure 8:
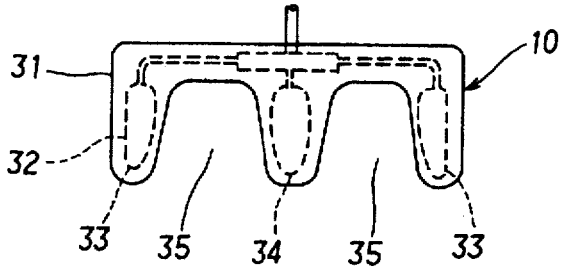
FIG. 8 is a top view showing a second embodiment of a footrest for the chair-type air massage device of the present invention, the footrest having air bags for a leg massage.

In the above embodiment, the air bags 34*a*, 34*a* separately provide and relieve pressure against a user's calf muscles from both right and left sides. However, the center air bags 34 can be combined into a single center air bag 34 as shown in FIG. 8.

Figure 9:
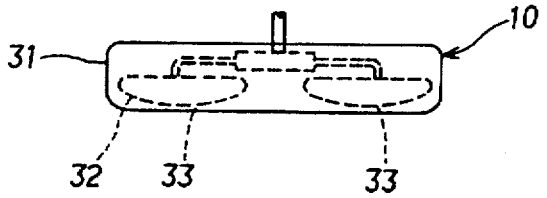
FIG. 9 is a top view showing a third embodiment of a footrest for the chair-type air massage device of the present invention, the footrest having air bags for a leg massage.

Further, the footrest 10 may only include the right and left air bags 33, 33 which are positioned along a line to provide and relieve the pressure against the back of a user's calf muscles as shown in FIG. 9.

Figure 10:
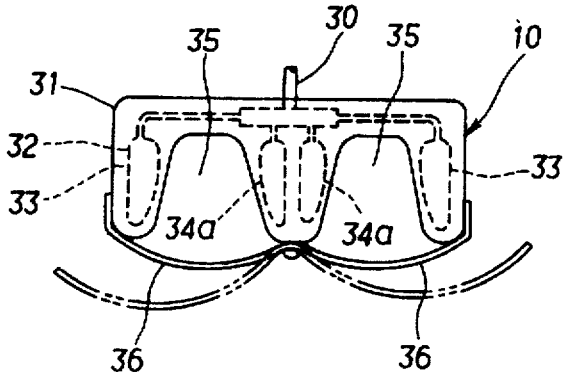
FIG. 10 is a top view showing a fourth embodiment of a footrest for the chair-type air massage device of the present invention, the footrest having air bags for a leg massage.

Further, shin covers 36 may be removably disposed in front of the left air bag 33 and the center left air bag 34*a*, and in front of the right air bag 33 and the center right air bag 34*a*, as shown in FIG. 10. The shin covers 36 retain a user's legs within the cavities 35 during a leg massage. The shin covers 36 can include additional air bags. Velvet-type fasteners, such as Velcro, or hook buttons may be used to retain the shin covers 36 during a leg massage.

The chair-type air massage device of the above embodiment may include air bags for providing a leg massage together with a neck and back massage. However, the above embodiment may also include only the air bags 32 for a leg massage by omitting the remaining air bags.

In the above embodiment, instead of using the linkage 11 and the manual lever 12 as a means for varying the position of the footrest 10 relative to the seat 2, the footrest 10 may be connected to the seat 2 via a rotatable shaft which changes the position of the footrest 10 by rotating the footrest 10 around the shaft by operating a pressure cylinder.

The present invention can provide an air massage to a user's legs while the user is comfortably lying on his back by reclining the backrest rearwardly. When reclined, the user may position his legs between the air bags 32 for a leg massage wherein compressed air is used to alternately expand and contract the air bags 32.

Further, the present invention has the footrest which is capable of changing position between the projected position and the retracted position on the front end of the seat so that an air massage can be provided to a user's legs while putting his legs on the footrest in the projected position and comfortably lying on his back. When the footrest is in the retracted position, an air massage can be provided to the user in a sitting position without being disturbed by the footrest.

Further, the present invention includes removable shin covers in front of the air bags 32 so that a uses legs can be retained without being pushed out of the cavities 35 by the air bags 32. Thus, an air massage can be provided efficiently to a user's whole legs by using the shin covers while expanding and contracting the air bags.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair-type air massage device, comprising:

a seat;

a reclinable backrest pivotally joined to a first end of the seat;

a footrest pivotally joined to a second end of the seat, the footrest being pivotable between a forwardly projecting position and a retracted position, the retracted position having the footrest adjacent the seat, the footrest in the forwardly projecting position extending in a substantially level orientation generally aligned with a top surface of the seat, and the footrest in the retracted position extending in a generally vertical orientation below a front edge of the seat;

a plurality of air bags disposed on the footrest for providing a leg massage when said footrest is in either one of said forwardly projecting and retracted positions, the plurality of air bags including a right-side air bag, a left-side air bag, a right-center air bag and a left-center air bag, the right-center and left-center air bags being positioned between the right-side and left-side air bags;

the footrest having a planar portion and right, left and center cantilevered portions, the cantilevered portions extending outwardly from the planar portion, the left-side air bag being housed in the left cantilevered portion, the right-side air bag being housed in the right cantilevered portion, and the left-center and right-center air bags being housed within the center cantilevered portion of the footrest, the right-side air bag and the right-center air bag being spaced from one another defining a first concave space, the first concave space being adapted to receive a right leg of a user therein, and the left-side air bag and the left-center air bag being spaced from one another defining a second concave space, the second concave space being adapted to receive a left leg of a user therein; and an intake/exhaust control assembly which supplies and exhausts compressed air to and from the plurality of air bags, the intake/exhaust assembly including an air source positioned below the seat, a distributor connected to the air source being positioned in the seat, and hoses connecting the distributor to the plurality of air bags.

2. The air massage device according to claim 1, wherein a first shin cover is removably positioned over the left-side air bag and the left-center air bag, the first shin cover selectively enclosing the second concave space, and wherein a second shin cover is removably positioned over the right-side air bag and the right-center air bag, the second shin cover selectively enclosing the first concave space.

* * * * *